US012460843B2

(12) United States Patent
Trabucchi et al.

(10) Patent No.: US 12,460,843 B2
(45) Date of Patent: Nov. 4, 2025

(54) VAPOUR COMPRESSION REFRIGERATION SYSTEM WITH ROTARY PRESSURE EXCHANGER AND MANAGEMENT METHOD OF SUCH A SYSTEM

(71) Applicant: EPTA S.p.A., Milan (IT)

(72) Inventors: Stefano Trabucchi, Milan (IT); Daniele Mazzola, Milan (IT); Ignacio Varela Chaparro, Milan (IT)

(73) Assignee: EPTA S.P.A., Milan (IT)

( * ) Notice: Subject to any disclaimer, the term of this patent is extended or adjusted under 35 U.S.C. 154(b) by 153 days.

(21) Appl. No.: 18/482,397

(22) Filed: Oct. 6, 2023

(65) Prior Publication Data

US 2024/0125526 A1 Apr. 18, 2024

(30) Foreign Application Priority Data

Oct. 10, 2022 (IT) ..... 102022000020811

(51) Int. Cl.
*F25B 41/30* (2021.01)
*F25B 13/00* (2006.01)

(52) U.S. Cl.
CPC ..... *F25B 41/30* (2021.01); *F25B 13/00* (2013.01)

(58) Field of Classification Search
CPC ..... F25B 41/30; F25B 41/20; F25B 13/00; F25B 2309/004; F25B 2309/005; F04F 13/00
See application file for complete search history.

(56) References Cited

U.S. PATENT DOCUMENTS

2012/0103005 A1* 5/2012 Kopko ..... F25B 1/047 62/430
2022/0397317 A1* 12/2022 Thatte ..... F25B 41/00

FOREIGN PATENT DOCUMENTS

| | | | |
|---|---|---|---|
| DE | 282744 | A5 | 9/1990 |
| GB | 2554560 | A | 4/2018 |
| WO | 2022010749 | A1 | 1/2022 |
| WO | 2022010750 | A1 | 1/2022 |

OTHER PUBLICATIONS

Italian Search Report for Patent Application No. IT 2022000020811, mailed Mar. 17, 2023, Munich, DE.

* cited by examiner

*Primary Examiner* — Miguel A Diaz
(74) *Attorney, Agent, or Firm* — Armstrong Teasdale LLP

(57) ABSTRACT

A vapour compression refrigeration system has a main refrigerant circuit having a main gas cooler or condenser arranged in a high pressure branch, a first main evaporator arranged in a first low pressure branch, a main compressor fluidically connecting the first low pressure branch to the high pressure branch, and an expansion device connecting the high pressure branch to an intermediate pressure branch. The system has a by-pass branch connecting the high-pressure branch to the intermediate pressure branch and provided with a by-pass valve, a secondary refrigerant circuit having a secondary gas cooler or condenser arranged in a secondary high pressure branch, a secondary evaporator arranged in a secondary low pressure branch, and a secondary expansion device connecting the secondary high pressure branch to the secondary low pressure branch. A rotary pressure exchanger is fluidically connected to the by-pass branch downstream of the by-pass valve and the secondary refrigerant circuit.

16 Claims, 15 Drawing Sheets

VAPOUR COMPRESSION REFRIGERATION SYSTEM WITH ROTARY PRESSURE EXCHANGER AND MANAGEMENT METHOD OF SUCH A SYSTEM

CROSS-REFERENCE TO RELATED APPLICATION

This application claims priority to Italian Patent Application No. 102022000020811 filed Oct. 10, 2022, the entire contents of which is hereby incorporated in its entirety by reference.

FIELD OF THE INVENTION

The present invention relates to a vapour compression refrigeration system with rotary pressure exchanger and to a management method of such a system.

The refrigeration system and the management method according to the present invention find particular application in the commercial and industrial refrigeration industry.

The refrigeration system is capable of operating both in subcritical mode as well as in transcritical mode, according to the needs of the refrigeration system. Preferably, R744 refrigerant (CO2) is used as the refrigerant. The refrigeration system can be of the booster or non-booster type.

BACKGROUND ART

Refrigeration systems which use CO2 as refrigerant fluid are widely known in the art and have been widely used in the last ten years, especially in the commercial refrigeration industry. While on the one hand the advantages linked to the low environmental impact of such a fluid are evident, on the other hand the low critical temperature of CO2 makes them particularly inefficient at high ambient temperatures, especially in the standard system configuration referred to as a "booster", making it mandatory to operate the system in a transcritical mode.

A booster system is configured when compressors of a lower evaporation level discharge in the suction of compressors of a higher evaporation level, i.e., compressors of at least two evaporation levels are connected in series. FIG. 1 shows a simplified diagram of a booster refrigeration system with liquid receiver (flash tank), in which A indicates the gas cooler or condenser, B the expansion member upstream of the receiver, C the liquid receiver, D1 and D2 two evaporators in parallel on two different pressure levels, E1 and E2 two compression stages.

There are two main causes of inefficiency of such a refrigeration system:

- the isoenthalpic expansion through the expansion member B (transcritical expansion valve), which is an essential part of the process but dissipates a high amount of mechanical energy, and
- the high flash gas production caused by the high vapour content at the inlet of the receiver downstream of the expansion member B.

The issue of mechanical energy recovery from the transcritical isoenthalpic expansion process in commercial CO2 refrigeration plants is known in the art and has been the subject of research for many years, at both an industrial and academic level. The technologies studied are many and varied, and some of them are already mature and commercially available. One such technology is based on the insertion of an ejector in the refrigeration system. However, the use of high-precision mechanics, such as an ejector, makes such technologies still expensive; furthermore, the members with fixed geometry make it difficult to manage the plant at the partial and oscillating loads typical of commercial refrigeration systems. Other technologies are still limited to research laboratories or have not had the hoped-for commercial success (e.g., linear, rotary expander, . . . ) due to the difficult management of two-phase flows and the correlated high mechanical stresses.

Another method for increasing the efficiency of refrigeration plants, both subcritical and transcritical, includes cooling the liquid exiting the condenser or cooling the hot gas exiting the gas cooler to a temperature lower than ambient temperature by means of an additional compressor which for the sake of brevity will both be referred to as sub-cooling in the following text. Another known system variant is that of flash gas compression. Therefore, the market offers many different technologies with a high degree of maturation (e.g., parallel compression, mechanical sub-cooling). Such solutions have favoured a progressive diffusion and improvement of transcritical CO2 technology and moved what is known as the "CO2 equator" southwards, but in some cases, they still use synthetic refrigerants (mechanical sub-coolers) and allow a benefit in terms of efficiency obtained, however only through additional compression stages (flash-gas).

A relatively recent technological solution includes inserting a rotary pressure exchanger PX into a refrigeration system as diagrammatically shown in FIG. 2, where the pressure exchanger is indicated with PX.

Technological solutions of this type are described, for example, in international applications WO2022/010749A1 and WO2022/010750A1.

A pressure exchanger is a mechanical component which has in the past found its main field of development and application in reverse osmosis desalination ("SWRO") plants, where it is used to exchange (and recover) pressure energy between the flow of high-salt water, discarded downstream of the membrane and still pressurised, and low-pressure seawater with which the membrane itself is fed. Such a component leads to substantial energy savings during the useful life of the plant, as well as a reduction in the size of the main pump and thus in investment costs.

The operating principle of a rotary pressure exchanger is described below with reference to FIG. 3, which shows the flows entering and exiting such a device PX. Through a series of symmetrical channels dug along the direction of the rotation axis of a ceramic cylinder ("rotor"), a low-pressure fluid cylinder is put in direct contact with a high-pressure flow entering from the port HPin, so that the latter pushes the lower-pressure fluid cylinder, compressing it towards the outlet HPout. The resulting fluid cylinder comprised between HPin and HPout translates due to the rotation of the rotor and is exposed to the lower pressure level, expands through a quasi-isoentropic process, and is expelled from the port LPout, also pushed by a "fresh" flow entering through LPin. The fluid cylinder between LPin and LPout translates due to the rotation of the rotor and is exposed to the higher-pressure level, restarting the cycle. By virtue of suitably designed fluid inlet and outlet ports, the process is repeated continuously, sucking and compressing more or less mass flow depending on the rotation speed of the ceramic cylinder. To this end, the pressure exchanger PX is provided with a motor and an inverter for controlling the rotation speed.

One of the key aspects of a pressure exchanger is that it is not capable of perfectly equalising the pressures on both the high- and low-pressure side. In other words, there must always be a positive pressure difference between HPin and HPout and between LPin and LPout, so that the flows entering the ports HPin and LPin push the fluid cylinders towards HPout and LPout, respectively. This operating condition is caused by the presence of pressure drops along the circuit and is in no manner circumventable since it ensures the correct directionality of the flows entering and exiting.

A pressure exchanger operating in the correct conditions (defined in terms of rotation speed and pressures present at the terminals thereof) respects the following equations ($\dot{m}$ is the mass flow rate, p is the pressure):

$$\begin{cases} \dot{m}_{HP,in} = \dot{m}_{LP,out} \\ \dot{m}_{LP,in} = \dot{m}_{HP,out} \\ p_{HP,in} > p_{HP,out} \gg \gg p_{LP,in} > p_{LP,out} \end{cases}$$

For such a reason, in all known plant solutions for CO2 refrigeration plants with pressure exchanger PX, the so-called "low differential pressure devices" are also always present, i.e., devices which serve to create the pressure difference between HPin and HPout and between LPin and LPout necessary for the correct operation of the PX. In principle, these are mechanical actuators similar to compressors or pumps, but operating with small pressure jumps and large volumetric flow rates. To date, such devices are difficult to find on the market since the operating conditions are very far from the characteristic curves and envelopes typical of the world of refrigeration and beyond. They could also be made with ejectors but with increased circuit complexity and the problems already mentioned in the use of these devices. For this reason, they represent one of the main difficulties in applying PX in real refrigeration plants.

In more detail, referring to the diagram in FIG. 2, the following is in fact observed. In the diagram, the "low DP devices" are referred to as LPDP and HPDP. Such devices are necessary here due to the physical principle whereby a flow rate of fluid circulates from a point A to a point B of a plant if and only if the pressure of the fluid itself at point A is greater than that at point B to overcome the frictions associated with the motion of fluids in a conduit.

In particular, following the circuit loop around arrow A1 (points 1-2-3), at the exit of the gas cooler A all or at least part of the refrigerant fluid enters through the port HPin in the PX. In order to obtain the compression effect and the correct mass flow rate circle, the pressure at point 1 HPin must be greater than the pressure at point 2 HPout. Since point HPout 2 is subsequently and fluidically connected to the inlet of the gas cooler A, the pressure at point 3 must be greater than that of point 1 HPin, so as to ensure a mass flow in the direction indicated by the arrows. In essence, the following inequality must be valid:

$$p_3 > p_{1,HPin} > p_{2,HPout}$$

The HPDP is thus necessary in order to provide the pressure jump from point 2 to point 3.

The above also applies considering the fact that the flow rates at points 1, 2 and 3 are not equal, since in reality the flow rate at the port HPin flows internally towards the outlet LPout at point 5, i.e., the following equality exists:

$$\dot{m}_{HPin} = \dot{m}_{LPout}$$

Following the circuit loop around arrow A2 (points 4-5-6), the exiting mass flow from the PX to the port LPout enters the receiver C. A part of that flow is fished out by the receiver C at point 6. In order to obtain the expansion effect and the correct mass flow rate circle, the pressure at point 4 LPin must be greater than the pressure at point 5 LPout. Since point 6 is fluidically connected to the outlet of the receiver, the pressure at point 5 must be greater than that at point 6, so as to ensure a mass flow in the direction indicated by the arrows. In essence, the following inequality must be valid:

$$p_{4,LPin} > p_{5,LPout} > p_6$$

The LPDP is thus necessary in order to provide the pressure jump from point 6 to point 4. This does not mean that the flow rates in such points are equal, since in reality the flow rate in LPin flows internally towards the outlet HPout at point 2, i.e., the following equality exists:

$$\dot{m}_{LPin} = \dot{m}_{HPout}$$

The need for such members referred to as "low DP (or lift) devices" thus derives from the need to make the flow rates circulate in the desired direction.

Therefore, there is a need in the field of commercial and industrial refrigeration to have vapour compression refrigeration systems which can exploit the presence of a pressure exchanger to recover energy from the expansion process, without necessarily having to use low differential pressure devices.

SUMMARY OF THE INVENTION

Therefore, it is the object of the present invention to eliminate or at least mitigate the drawbacks of the aforementioned prior art, by providing a vapour compression refrigeration system with rotary pressure exchanger, which can recover energy from the expansion process through the pressure exchanger without the aid of low differential pressure devices.

It is a further object of the present invention to provide a vapour compression refrigeration system with rotary pressure exchanger, which is constructively simple to manufacture, with plant costs comparable to conventional plants.

It is a further object of the present invention to provide a vapour compression refrigeration system with rotary pressure exchanger, which is reliable and operatively simple to manage.

BRIEF DESCRIPTION OF THE DRAWINGS

The technical features of the invention according to the aforesaid objects can be clearly found in the contents of the claims hereinbelow and the advantages thereof will become more apparent from the following detailed description, given with reference to the accompanying drawings which show one or more embodiments thereof merely given by way of non-limiting example, in which:

Elements or parts in common to the embodiments described will be indicated hereafter using the same reference numerals.

DETAILED DESCRIPTION

Figure 1:
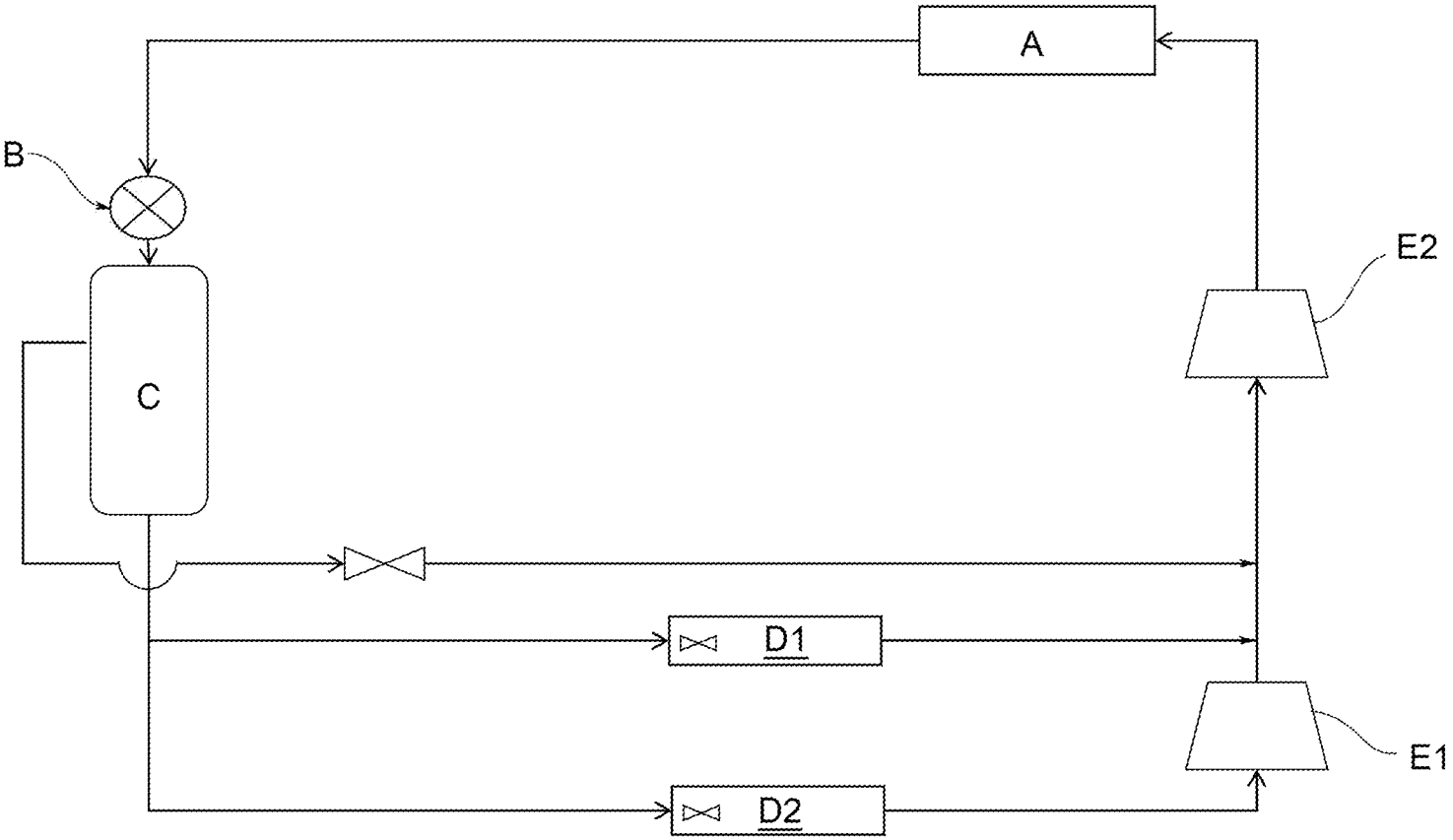
FIG. 1 shows a simplified diagram of a booster vapour compression refrigeration system.

The present invention relates to a vapour compression refrigeration system with a rotary pressure exchanger.

With reference to the accompanying drawings, reference numeral 1 overall indicates a refrigeration system according to the present invention.

The refrigeration system 1 operates according to a vapour compression cycle and can operate both in transcritical mode and in subcritical mode.

Preferably, the refrigeration system uses R744 (CO2) as the refrigerant fluid. Alternatively, the refrigeration system can use as refrigerant a mixture of transcritical or subcritical refrigerants with low or very low Global Warming Potential (GWP), possibly containing CO2.

A refrigeration system is said to be transcritical if it operates with pressures which exceed the critical pressure Pc of the working fluid. The peculiarity of such thermodynamic cycles is that there is no phase transition from gas to liquid in at least one of the heat exchange processes. In that section of the plant the fluid behaves like a dense gas.

In accordance with a general embodiment of the invention, the refrigeration system 1 comprises a main refrigerant circuit 2.

The main refrigerant circuit 2 in turn comprises:

- a high pressure branch BHP for circulating a refrigerant therethrough at a high pressure HP;
- a main gas cooler or condenser 10 arranged in the high-pressure branch BHP;
- at least a first low pressure branch BLP1 for circulating the refrigerant therethrough at a first low pressure;
- at least a first main evaporator 20' arranged in the first low pressure branch BLP1;
- at least one main compressor 30' which fluidically connects the first low pressure branch BLP1 to the high-pressure branch;
- an intermediate pressure branch BMP for circulating the refrigerant therethrough at an intermediate pressure between said high pressure and said first low pressure; and
- an expansion device 40 connecting the high-pressure branch BHP to the intermediate pressure branch BMP downstream of said gas cooler or condenser 10.

Preferably, the expansion device 40 consists of an electronic control valve, in particular motorised.

The intermediate pressure branch BMP is then connected to the first low-pressure branch BLP1 at the first main evaporator 20'.

Preferably, the main refrigerant circuit 2 can comprise a liquid receiver 70 which is arranged in the intermediate pressure branch BMP downstream of the expansion device 40.

The liquid receiver 70 can also be fluidically connected in suction to a dedicated compressor (solution not shown in the accompanying drawings) or alternatively to a compression stage of the main compressor 30' through a connection branch 71 provided with a regulation valve 72 so as to recirculate the refrigerant in gas phase to the high-pressure branch BHP. Such a connection thus allows to remove the flash gas present in the liquid receiver 70 created in the upstream expansion stage (in particular in the expansion device 40 and/or in a pressure exchanger 50 connected in parallel to the expansion device 40, as will be described in detail below).

In accordance with the embodiments shown in the accompanying drawings, the main refrigerant circuit 2 may comprise a second low pressure branch BLP2 for circulating the refrigerant therethrough at a second low pressure. Such a second low pressure branch BLP2 comprises a second main evaporator 20" and is fluidically connected upstream to the intermediate pressure branch BMP and downstream, directly or indirectly, to the high-pressure branch BHP through an additional compressor 30" which is arranged in series (as shown in the accompanying drawings) or parallel to said main compressor 30'.

In general, downstream of the expansion stage (40/50) and upstream of the compression stage (30', 30") the refrigeration system 1 can be provided with two or more evaporators 20', 20" or two or more groups of evaporators, connected to each other in parallel. In general, the system may include further low-pressure branches in addition to the second one with evaporator groups and a further compressor which, similarly to 30", discharge the flow rate thereof to the suction of the main compressor 30'.

Advantageously, each of the evaporators, or groups of evaporators, will be provided with secondary expansion members and control devices thereof.

Advantageously, the main compressor 30' can comprise two or more compression stages connected to each other in series. Each of said compression stages can consist of separate compressors or be integrated in a single compressor.

Advantageously, the main compressor 30' can comprise at least one compression stage defined by two or more compressors, connected to each other in parallel. The power supply can include the use of one or more inverters to vary the speed thereof.

The refrigeration system 1 can comprise a single evaporator or a group of evaporators connected in parallel in the same suction line, or, as shown in the accompanying drawings, it can comprise one or more evaporators or groups of evaporators 20', 20", which preferably operate at different evaporation levels.

Preferably, if there are two or more evaporators 20', 20" operating at different evaporation levels, they are connected in suction to different compression stages 30' and 30".

As shown in the accompanying drawings, the main refrigerant circuit 2 can be configured as a booster system. A booster system is configured when compressors of a lower evaporation level discharge in the suction of compressors of a higher evaporation level, i.e., compressors of at least two evaporation levels are connected in series.

Alternatively, the main refrigerant circuit 2 can be configured as a non-booster system. A non-booster system is configured when compressors of a lower evaporation level discharge in the same branch as compressors of a higher evaporation level, i.e., compressors of at least two evaporation levels are connected in parallel to the discharge.

In accordance with a first aspect of the present invention, the main refrigerant circuit 2 comprises a by-pass branch BB connecting the high-pressure branch BHP to the intermediate pressure branch BMP downstream of said expansion device 40 and provided with a by-pass valve 60. In other words, the by-pass branch BB defines a branch connected in parallel to the circuit section in which the expansion device 40 is installed to allow a partial or total deviation of the refrigerant flow from the expansion device 40.

In accordance with a second aspect of the present invention, the refrigeration system 1 comprises a secondary refrigerant circuit 100 in addition to the main refrigerant circuit 2.

The secondary refrigerant circuit 100 in turn comprises:

- a secondary high pressure branch BHPs for circulating the refrigerant therethrough at a secondary high-pressure HPs lower than said high pressure HP;
- a secondary gas cooler or condenser 111 arranged in the secondary high pressure branch BHPs;
- a secondary low-pressure branch BLPs for circulating the refrigerant therethrough at a secondary low-pressure LPs;
- at least one secondary evaporator 112 arranged in the secondary low-pressure branch BLPs;
- a secondary expansion device 113 connecting the secondary high pressure branch BHPs to the secondary low-pressure branch BLPs downstream of said secondary gas cooler or condenser 111.

The secondary low-pressure branch BLPs is then connected to the secondary high pressure branch BHPs at a pressure exchanger 50, as will be described below.

In accordance with a third aspect of the present invention, the refrigeration system 1 comprises a rotary pressure exchanger 50 which is fluidically connected to:

- the by-pass branch BB downstream of the by-pass valve 60 and
- the secondary refrigerant circuit 100.

More in detail, the rotary pressure exchanger 50 comprises a high-pressure inlet port HPin, a low-pressure inlet port LPin, a high-pressure outlet port HPout, and a low-pressure outlet port LPout.

A detailed description of a rotary pressure exchanger is not provided, as it is a device per se well known to those skilled in the art. It is merely noted that the rotary pressure exchanger 50 is provided with a motor with inverter adapted to control the rotation speed of the exchanger and thus the flow rates treated by the exchanger itself.

According to the present invention, the rotary pressure exchanger 50 is configured to:

- receive the refrigerant entering the high-pressure inlet port HPin from the high-pressure branch BHP of the main refrigerant circuit 2 through the by-pass branch BB,
- receive the refrigerant entering the low-pressure inlet port LPin from the secondary low-pressure branch BLPs of the secondary refrigerant circuit 100,
- exchange pressure between the refrigerant at the high-pressure HP and the refrigerant at the secondary low pressure LPs,
- introduce the refrigerant exiting the high-pressure outlet port HPout into the secondary high pressure branch BHPs of the secondary refrigerant circuit 100; and
- introduce the refrigerant exiting the low-pressure outlet port LPout into the intermediate pressure branch BMP of the main refrigerant circuit 2 through the by-pass branch BB.

As shown in FIGS. 4 to 11, the rotary pressure exchanger 50 is then fluidically connected to the by-pass branch and the secondary refrigerant circuit 100 as follows:

- the high-pressure inlet port HPin is connected to the high-pressure branch BHP of the main refrigerant circuit 2 through the by-pass branch BB;
- the low-pressure inlet port LPin is connected to the secondary low-pressure branch BLPs of the secondary refrigerant circuit 100;
- the high-pressure outlet port HPout is connected to the secondary high pressure branch BHPs of the secondary refrigerant circuit 100; and
- the low-pressure outlet port LPout is connected to the intermediate pressure branch BMP of the main refrigerant circuit 2 through the by-pass branch BB.

Operatively, the rotary pressure exchanger 50 then acts as an alternative expansion member for the main refrigerant circuit 2 and as a compressor for the secondary refrigerant circuit 100.

As will be discussed below, the rotary pressure exchanger 50 acts as an alternative expansion member for the main refrigerant circuit 2. Acting on the degree of opening of the expansion device 40 and the rotation speed of the rotary pressure exchanger 50, it is possible to adjust the flow rate of refrigerant entering the same pressure exchanger.

Operatively, the pressure exchanger 50 allows to recover pressure energy from the expansion stage of the main refrigerant circuit 2 (creating a quasi-isoentropic expansion process) and to transfer it as compression work to the compression stage of the secondary refrigerant circuit 100.

It follows that the energy necessary for the operation of the secondary refrigerant circuit 100 is substantially all recovered by the quasi-isoentropic expansion process carried out by the pressure exchanger 50.

According to the present invention, by virtue of the presence of the secondary refrigerant circuit 100, the energy recovered through the rotary pressure exchanger 50 from the expansion stage of the main refrigerant circuit 2 is transformed into cooling power made available to the secondary evaporator 112 of the secondary refrigerant circuit 100.

Unlike the refrigeration systems of the background art which use a pressure exchanger, the refrigeration system 1 according to the present invention does not require low differential pressure devices to operate the pressure exchanger.

This derives from the fact that, according to the present invention, the secondary refrigerant circuit 100 is functionally separated from the main refrigerant circuit 2, in the sense that the two circuits are fluidically connected to each other continuously only at the pressure exchanger 50.

Figure 2:
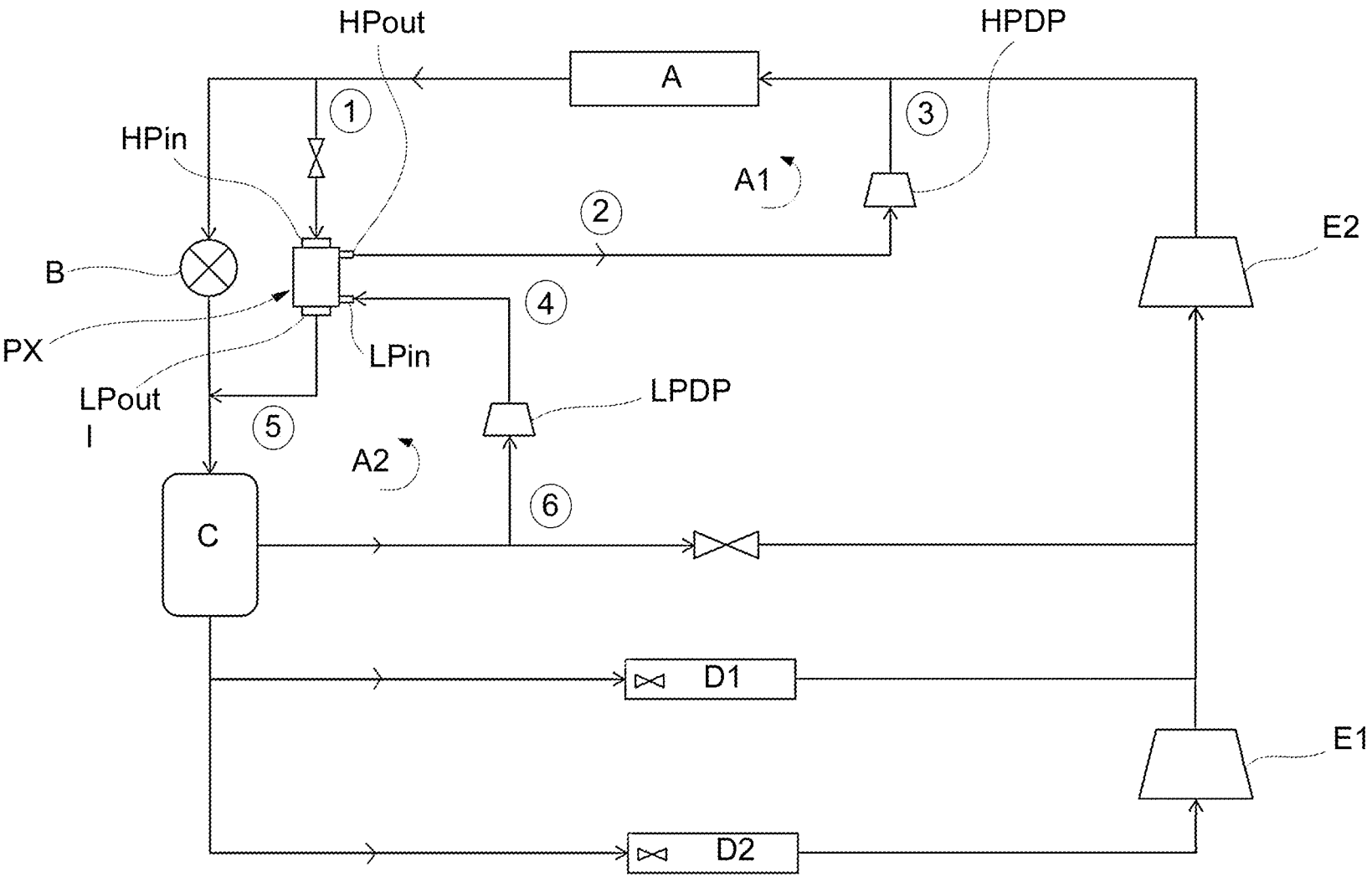
FIG. 2 shows a simplified diagram of a traditional vapour compression refrigeration system with rotary pressure exchanger.
Figure 3:
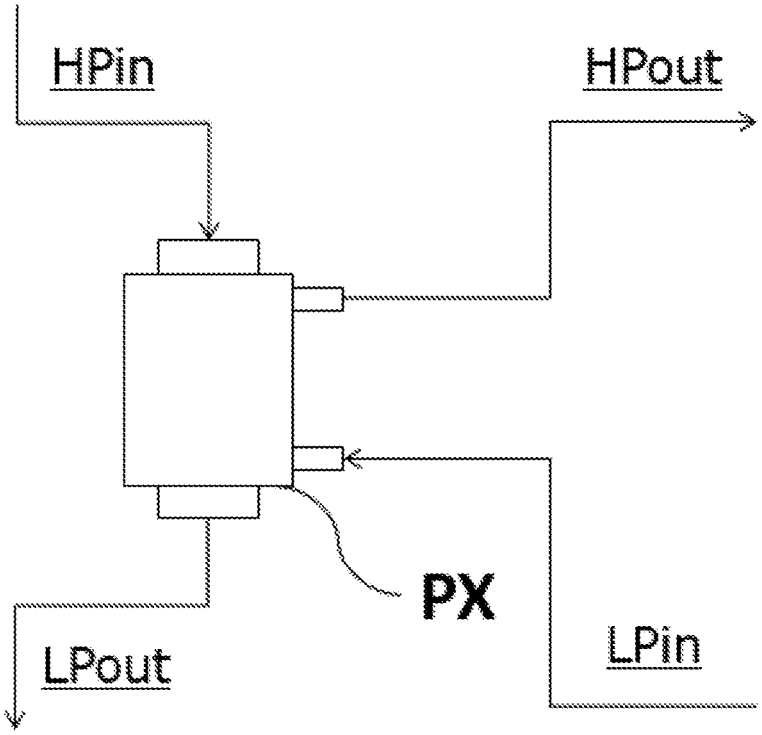
FIG. 3 diagrammatically shows the nomenclature of the fluid flows entering and exiting in a rotary pressure exchanger.

In this sense, it should be noted that, unlike the solutions of the background art (see FIG. 2), in the refrigeration system 1 according to the present invention there is no fluidic connection between HPin and HPout outside the rotary pressure exchanger 50; in fact, the flow of refrigerant exiting HPout is not brought in input to the main gas cooler or condenser 10 and thus to the pressure of HPin, but to the secondary gas cooler or condenser 111 which operates at a lower pressure than HPin. Therefore, it is not necessary to raise the HPout pressure up to the HPin pressure to allow fluid circulation.

Furthermore, in the refrigeration system 1 according to the present invention there is no fluidic connection between LPin and LPout outside the rotary pressure exchanger 50; in fact, the flow of refrigerant entering LPin is not fished out by the intermediate pressure branch BMP of the main refrigerant circuit 2 and in particular by the liquid receiver 70 (if provided), i.e., it is not fished out at a lower pressure with respect to LPin. Therefore, it is not necessary to raise the pressure of the fluid exiting LPout up to the pressure LPin to allow fluid circulation.

As will be described below in detail, the secondary refrigerant circuit 100 can also be fluidically connected to the main refrigerant circuit 2 through a refrigerant supply branch 80, intercepted by at least one valve 81*a* or 81*b* which is opened only under certain operating conditions.

The vapour compression refrigeration system 1 according to the present invention thus allows energy to be recovered from the expansion process through the pressure exchanger without the aid of a low differential pressure device.

Furthermore, by virtue of the invention and in particular by virtue of the quasi-isoentropic expansion process in the pressure exchanger, at least the effects related to the two main causes of inefficiency of a refrigeration system are mitigated. In fact, the near-isentropic expansion in the pressure exchanger not only allows to recover energy in the form of pressure energy, but also to reduce the vapour content in the expanded refrigerant. In the preferred case in which a liquid receiver is present, a lower vapour content allows to reduce the flash gas production and thus the recirculated flow rate to the high-pressure branch. This results in a reduction in the gas flow rate and a consequent decrease in the nominal size of the components involved, including the compressor 30' and/or the compressors required to recirculate the flash gas.

Preferably, as shown in the accompanying drawings, the refrigeration system 1 comprises a non-return valve 61 arranged in the by-pass branch BB downstream of the rotary pressure exchanger 50.

Operatively, if there is an at least partial flow of refrigerant through the expansion device 40, the non-return valve 61 ensures the correct flow along the by-pass branch BB, preventing the backflow of refrigerant from the intermediate pressure branch BMP towards the pressure exchanger 50.

Secondly, the non-return valve 61 serves to discharge any overpressures in the secondary refrigerant circuit 100.

Operatively, the secondary refrigerant circuit 100 is progressively loaded with refrigerant by opening the by-pass valve 60 and driving the rotary pressure exchanger 50 (by acting on the motor/inverter) until a regime situation is reached.

However, it may occur that at regime the quantity of refrigerant and thus the pressure in the secondary high pressure branch BHPs is not such as to ensure an efficient operation of the secondary refrigerant circuit 100. In such a case, it is not possible to change the situation by acting on the pressure exchanger 50.

Preferably, with a view to ensuring the maximum efficiency of the secondary refrigerant circuit 100, the refrigeration system 1 comprises a charge management system 800 in the secondary refrigerant circuit. Operatively, such a charge management system 800 is adapted to supply the secondary refrigerant circuit 100 with further refrigerant under certain operating conditions which can be preset or variable.

Such a charge management system 800 comprises an (already mentioned) refrigerant supply branch 80 which:

fluidically connects the high-pressure branch BHP of the main refrigerant circuit 2 to the secondary refrigerant circuit 100 downstream of the secondary gas cooler or condenser 111 and upstream of the secondary expansion device 113, and is provided with at least one regulation valve 81*a* or at least one differential non-return valve 81*b*.

Advantageously, the refrigerant supply branch 80 can be provided with both a regulation valve 81*a* and a differential non-return valve 81*b*, connected to each other in series or in parallel.

Advantageously, the charge management system 800 can be made according to different plant solutions which vary from each other both in terms of components and in terms of control strategy.

Figure 15:
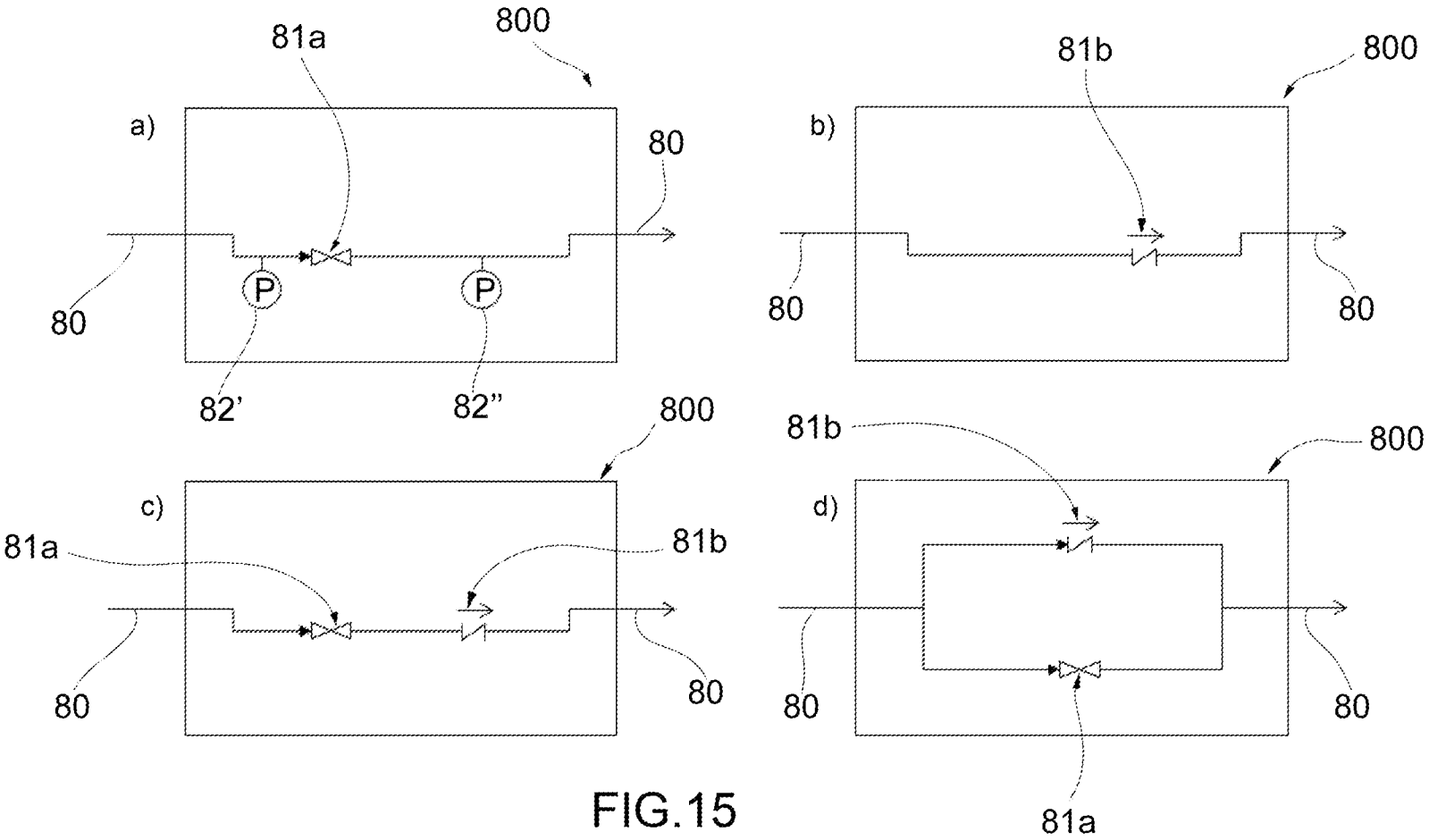
FIGS. 15 *a, b, c, d* show four possible plant variants for producing the charge management system shown in FIG. 5.

More in detail, in a first variant (shown in FIG. 15*a*), the charge management system 800 comprises a single valve, consisting of a regulation valve 81*a* and two pressure sensors 82' and 82", one upstream and one downstream of the valve, respectively. The control logic is as follows: the regulation valve 81*a* opens if $p_{upstream}-p_{downstream}>\Delta p_{threshold}$, with variable or parameterisable opening threshold. If the condition does not exist, the valve is closed.

In a second variant (shown in FIG. 15*b*), the charge management system 800 comprises a single valve, consisting of a differential non-return valve 81*b*, with differential opening pressure set at a certain value $\Delta p_{threshold}$. The control logic is as follows: the differential non-return valve 81*b* opens if $p_{upstream}-p_{downstream}>\Delta p_{threshold}$, with fixed opening threshold. If the condition does not exist, the differential non-return valve 81*b* is closed.

In a third variant (shown in FIG. 15*c*), the charge management system 800 comprises a regulation valve 81*a* arranged upstream of a differential non-return valve 81*b*, with differential opening pressure set at a certain value $\Delta p_{threshold}$. The control logic is as follows: the regulation valve 81*a* opens if $p_{upstream}-p_{downstream}>\Delta p_{threshold}$, with variable or parameterisable opening threshold. If the condition does not exist, the regulation valve 81*a* is closed. The differential non-return valve 81*b* serves as a protection in case of undesired reverse flow.

In a fourth variant (shown in FIG. 15*d*), the charge management system 800 comprises a regulation valve 81*a* arranged parallel to a differential non-return valve 81*b*, with differential opening pressure set at a certain value $\Delta p_{threshold}$. The control logic is as follows: the regulation valve 81*a* opens if $p_{upstream}-p_{downstream}>\Delta p_{threshold}$, with variable or parameterisable opening threshold. If the condition does not exist, the regulation valve 81*a* is closed. The differential non-return valve 81*b* also opens if $p_{upstream}-p_{downstream}>\Delta p_{threshold}$, with fixed opening threshold. If the condition does not exist, the differential non-return valve 81*b* is closed. The regulation valve 81*a* is active during the start-up step of the secondary refrigerant circuit 100 to increase the pressure rise speed, if necessary (two parallel branches feeding the inlet of the secondary expansion device 113), or allows a more precise regulation of the pressure always at the inlet of the secondary expansion device 113.

As already highlighted above, by virtue of the presence of the secondary refrigerant circuit 100, the energy recovered through the rotary pressure exchanger 50 from the expansion stage of the main refrigerant circuit 2 is transformed into cooling power made available to the secondary evaporator 112 of the secondary refrigerant circuit 100. Advantageously, such cooling power can be used in various manners. Some preferred examples of use are described below.

Figure 4:
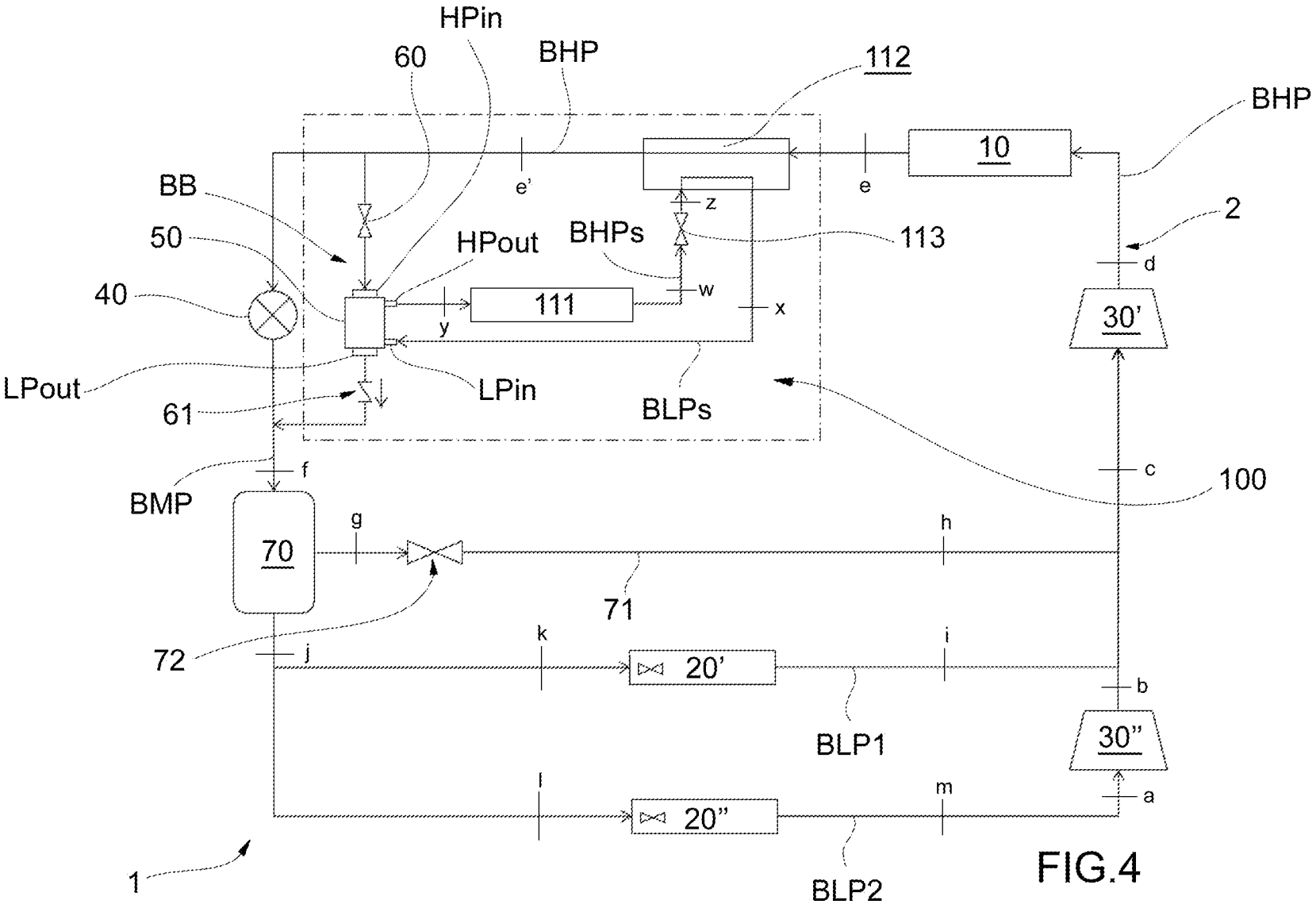
FIG. 4 shows a simplified diagram of a vapour compression refrigeration system in accordance with a first embodiment of the present invention.
Figure 5:
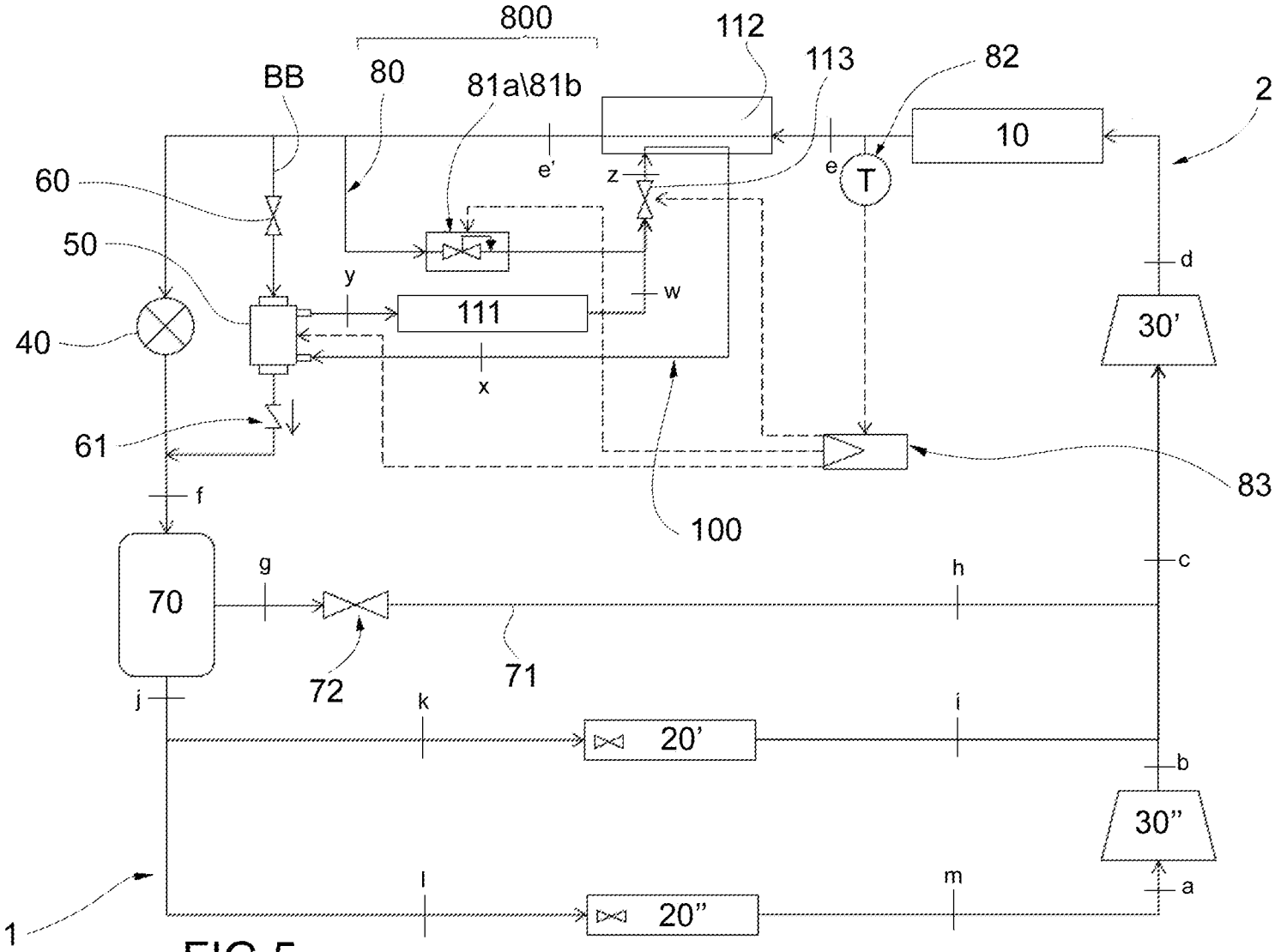
FIG. 5 shows a simplified diagram of the refrigeration system in FIG. 4, provided with a refrigerant charge management system.

In accordance with a preferred embodiment of the invention, shown in FIG. 4, the secondary evaporator 112 of the secondary refrigerant circuit 100 is thermally connected with the high-pressure branch BHP of the main refrigerant circuit 2 downstream of the main gas cooler or condenser 10 and acts as a sub-cooler for the main refrigerant circuit 2.

In more detail, the secondary evaporator 112 of the secondary refrigerant circuit 100:

- on a first side is fluidically inserted in a section of the main refrigerant circuit 2 between the gas cooler or condenser 10 and the expansion device 40 to be crossed by the entire flow of refrigerant exiting the gas cooler or condenser 10; and
- on a second side is fluidically inserted in the secondary refrigerant circuit 100 to be crossed by the flow of refrigerant exiting the secondary expansion device 113.

Operatively, in this case the cooling power made available to the secondary evaporator 112 is thus used to sub-cool the refrigerant exiting the main gas cooler or condenser 10.

Operatively, the secondary evaporator 112 (consisting in particular of a plate heat exchanger, added in fluid-dynamic series downstream of the main gas cooler or condenser 10) cools the flow of refrigerant (CO2) coming from the main compressors below ambient temperature. Within this component 112, a heat flow is established between the main refrigerant flow rate exiting the main gas cooler or condenser 10 and a secondary refrigerant flow at lower pressure. The secondary refrigerant flow flows inside the secondary refrigerant circuit 100 and downstream of the secondary evaporator 112 is compressed inside the rotary pressure exchanger 50, to then be cooled inside the secondary gas cooler or condenser 111, and finally expanded through the secondary expansion device 113 (expansion valve). The secondary expansion device 113 can be used as a control member, for example ensuring a certain degree of overheating at the low-pressure outlet of the secondary evaporator 112. The compression of the secondary refrigerant flow inside the pressure exchanger 50 occurs by virtue of the mechanical energy recovered from the high-pressure main flow which expands towards the intermediate pressure branch BMP (in particular towards the liquid receiver 70, if included) and which enters the pressure exchanger 50 through the by-pass valve 60. The flow portion which crosses the rotary pressure exchanger 50 with respect to the total high pressure main refrigerant flow can be more or less small; the expansion device 40 can work in parallel with respect to the series 60, 50 and 61, or remain closed and let all the flow pass through the rotary pressure exchanger 50, maximising energy recovery. The vapour content at the inlet of the liquid receiver 70, if included, is reduced both due to sub-cooling, and by virtue of quasi-isoentropic expansion instead of isoenthalpic expansion, while reducing the opening of the regulation valve 72 and reducing the overall flow rate processed by the flash gas recirculation compressors.

Figure 12:
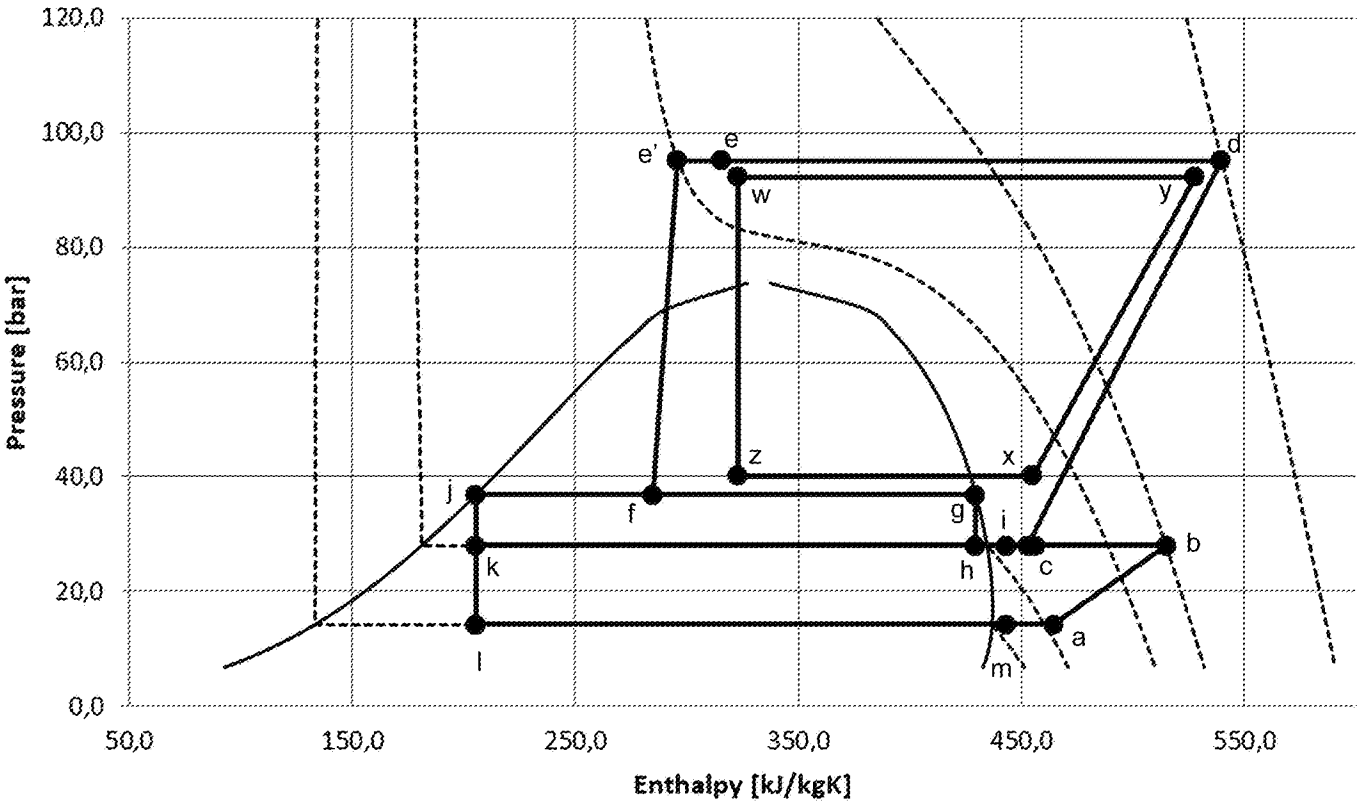
FIG. 12 shows, in a pressure—enthalpy diagram, the operation of the plant modes in FIGS. 4 to 7.

The secondary evaporator 112 can be activated in both transcritical (hot climates) and subcritical (cool climates) modes to improve the overall efficiency of the plant, reduce the electrical absorption of the compressors, reduce the discharge temperatures/pressures at the inlet of the main gas cooler or condenser 10 and thus also reduce oil consumption. The diagram p-h of the thermodynamic cycle corresponding to the plant in FIG. 4 is shown in FIG. 12.

With respect to background art solutions which use a pressure exchanger in a refrigeration system, the refrigeration system 1 according to the invention has the following main differences:

- absence of low-pressure differential devices;
- the secondary refrigerant circuit 100 is functionally separated from the main refrigerant circuit 2, thus being able to be switched off as needed;
- the secondary expansion device 113 can be dedicated to the control of different variables depending on the control logic adopted, for example the degree of overheating at the outlet of the secondary low-pressure branch BLPs thereof;
- the control of the rotation speed of the rotary pressure exchanger 50, which contributes to determining the refrigerant flow rate circulating in the secondary refrigerant circuit 100 and thus the degree of sub-cooling, is a function only of the volumetric flow rate entering the port HPin and, therefore, intrinsically stable with respect to the refrigeration capacity produced by the plant in real time;
- the secondary gas cooler or condenser 111, being functionally independent from the main one 10, can be physically separated from the latter or integrated according to needs and design constraints.

Figure 6:
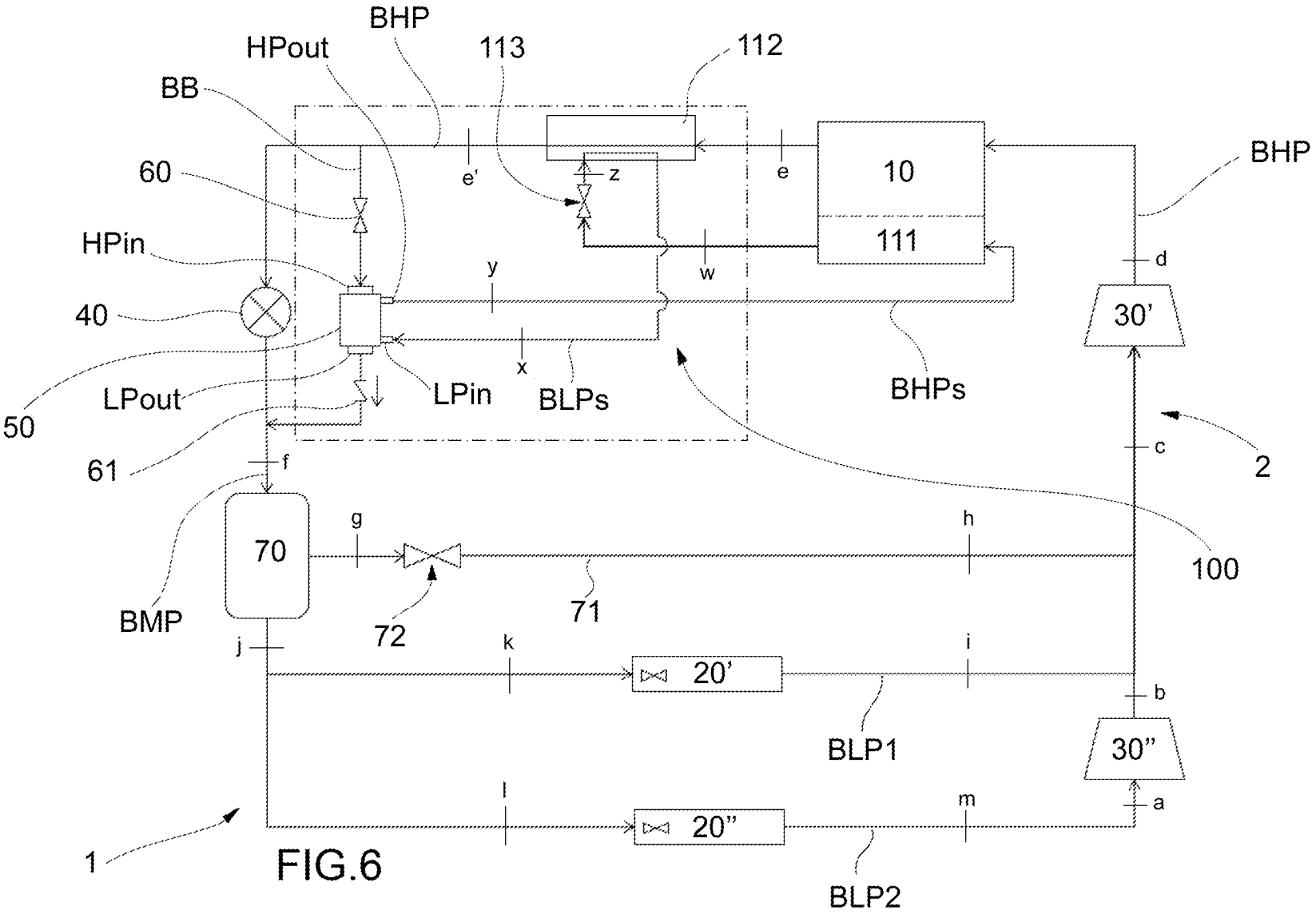
FIG. 6 shows a simplified diagram of a vapour compression refrigeration system in accordance with a second embodiment of the present invention.
Figure 7:
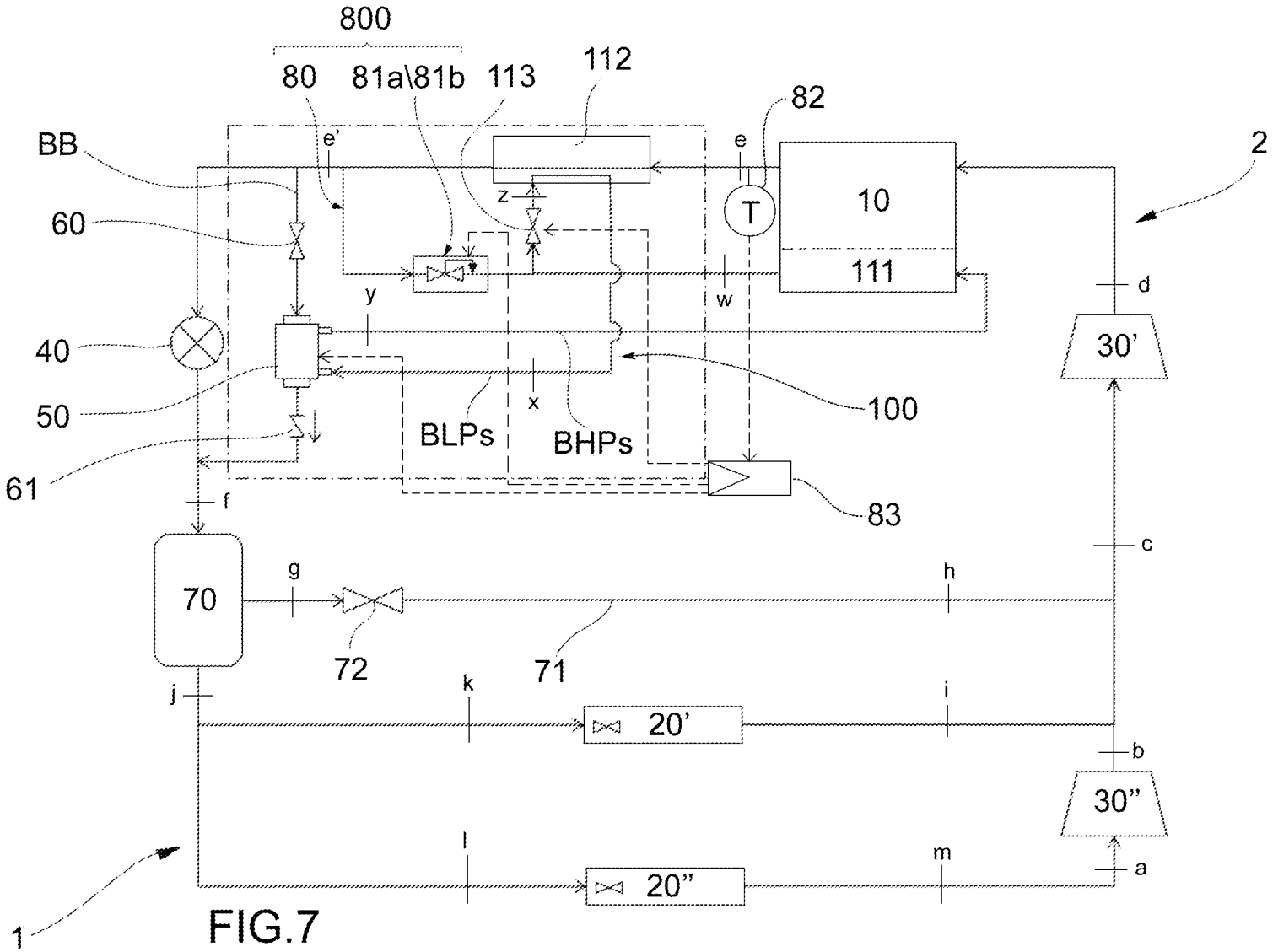
FIG. 7 shows a simplified diagram of the refrigeration system in FIG. 6, provided with a refrigerant charge management system.

In accordance with a second embodiment, shown in FIGS. 6 and 7, the secondary gas cooler or condenser 111 of the secondary refrigerant circuit 100 can be integrated in the main gas cooler or condenser 10. The integration of the secondary gas cooler or condenser 111 within the main one is obtained by dedicating a certain portion of the finned heat exchange battery to the secondary circuit. The advantage of such a solution is essentially linked to the fact that, even with greater construction complexity, the space occupied on the ground is smaller, useful in installations where there are more stringent constraints, furthermore, the complexity of installation and supply is reduced as it is a single object.

Figure 8:
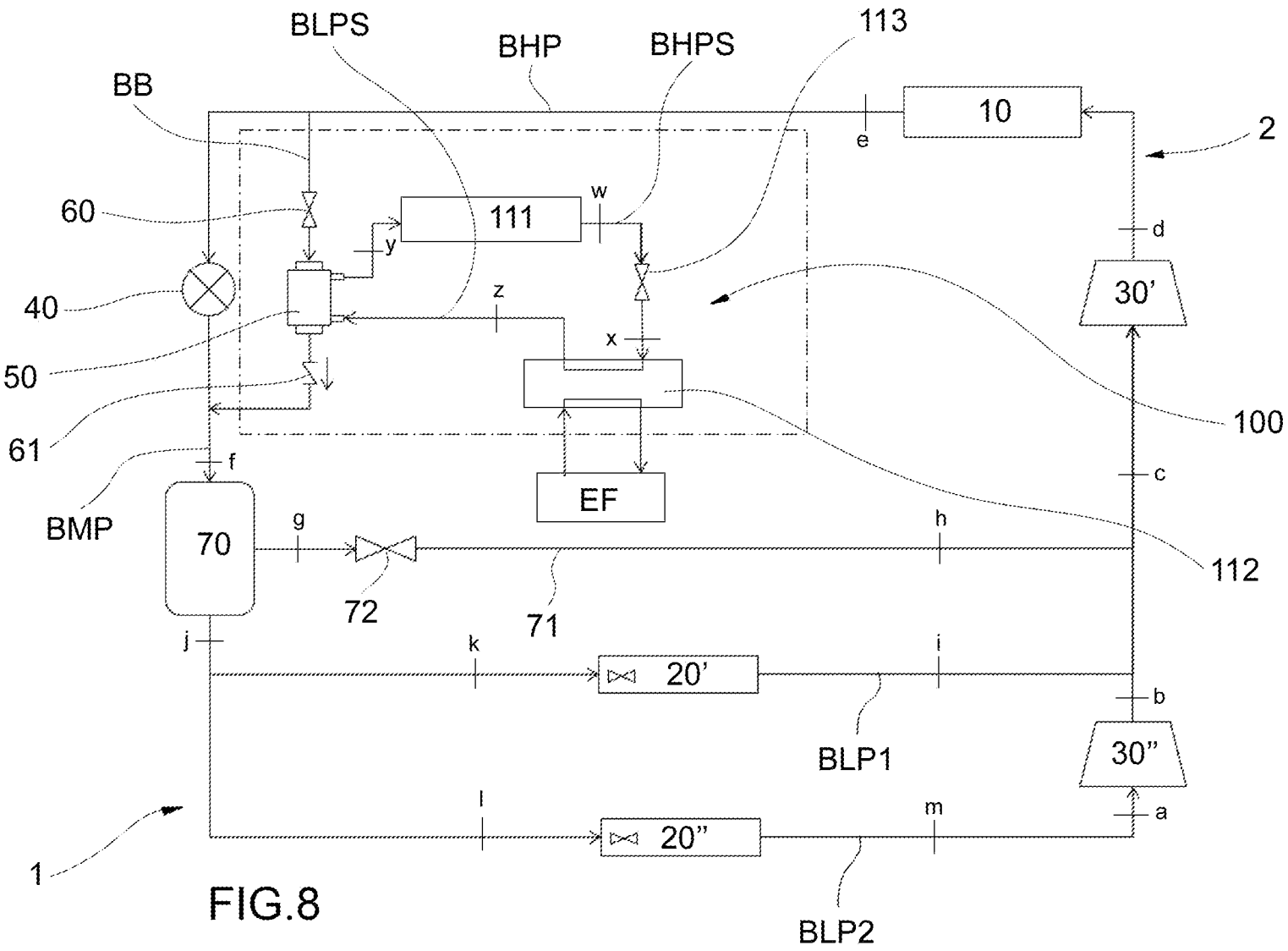
FIG. 8 shows a simplified diagram of a vapour compression refrigeration system in accordance with a third embodiment of the present invention.
Figure 9:
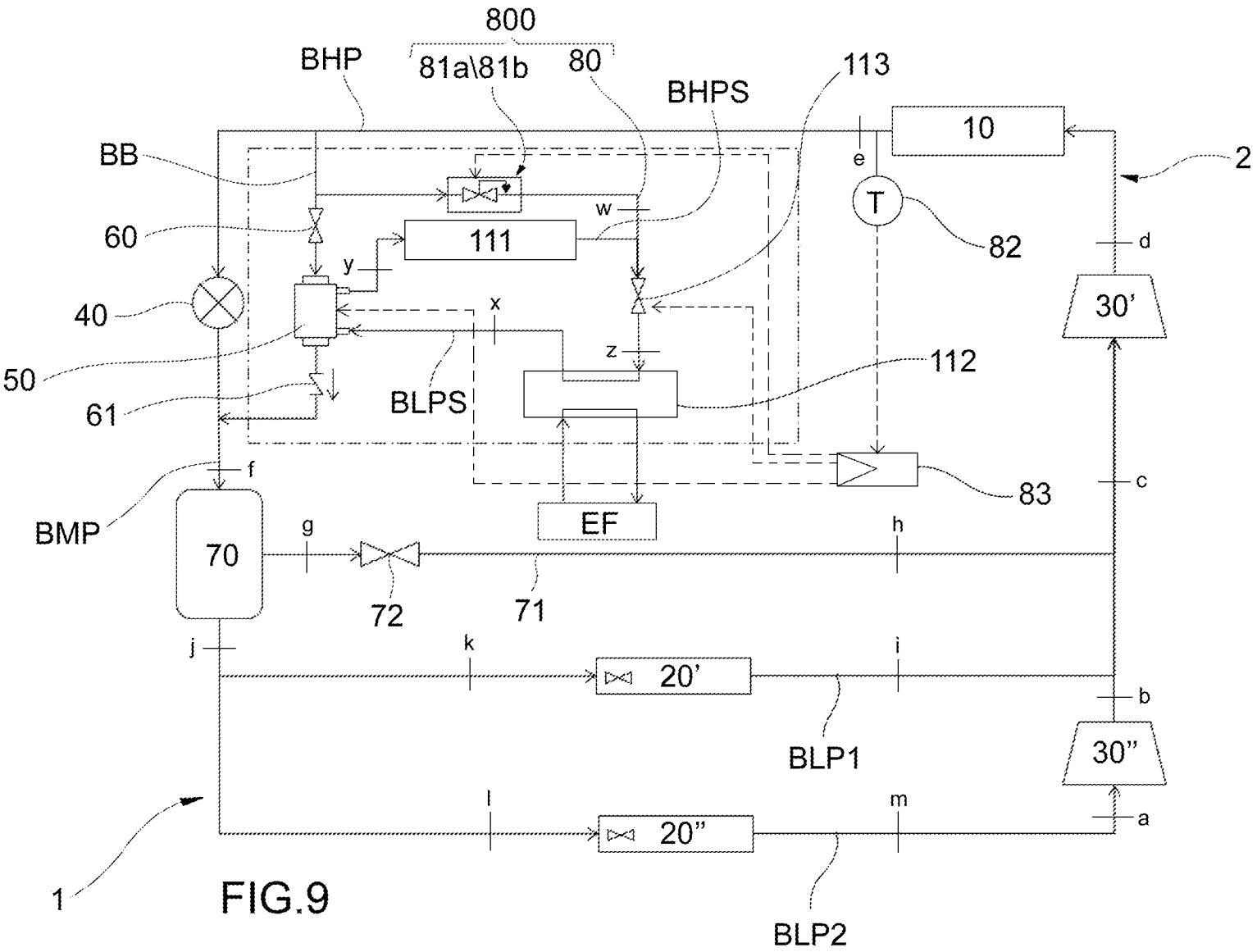
FIG. 9 shows a simplified diagram of the refrigeration system in FIG. 8, provided with a refrigerant charge management system.
Figure 13:
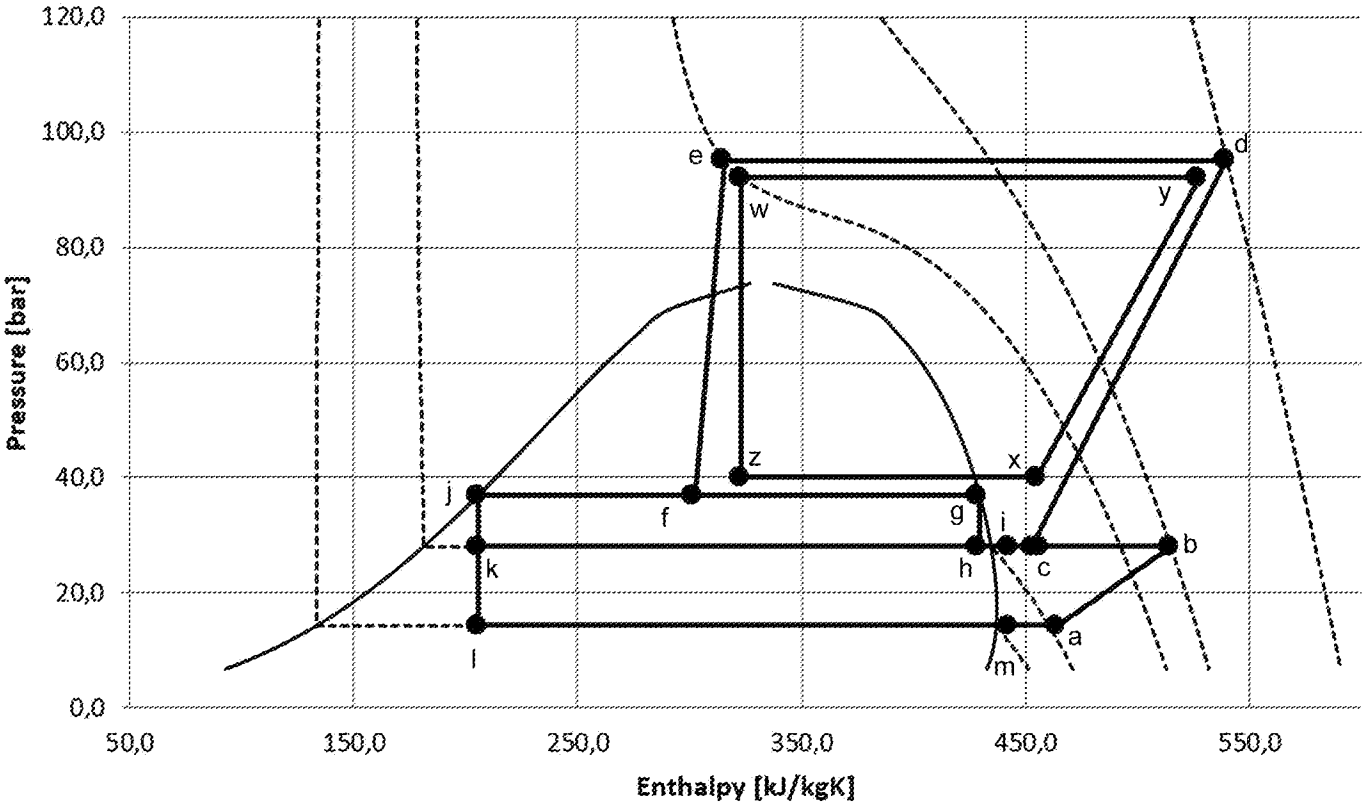
FIG. 13 shows, in a pressure—enthalpy diagram, the operation of the plant modes in FIGS. 8 and 9.

In accordance with a third embodiment, shown in FIGS. 8 and 9, the secondary evaporator 112 of the secondary refrigerant circuit 100 can be thermally connected to an external refrigerating utility EF. In particular, the cooling effect of the secondary circuit of the secondary evaporator 112 can be used so as to cool the heat-transfer fluid subordinated to a conditioning system to the typical conditions thereof (7-12° C.), whether it is water or air. Operatively, the effect of air conditioning would be a "waste" product of the refrigeration system, i.e., totally free of charge. Furthermore, the activation or deactivation of the secondary circuit has no effect on the main refrigerant circuit 2. In this case, the efficiency improvement is only visible at the level of overall efficiency given by refrigeration and air conditioning. The diagram p-h of the thermodynamic cycle of the plant in FIG. 8 is shown in FIG. 13.

Figure 10:
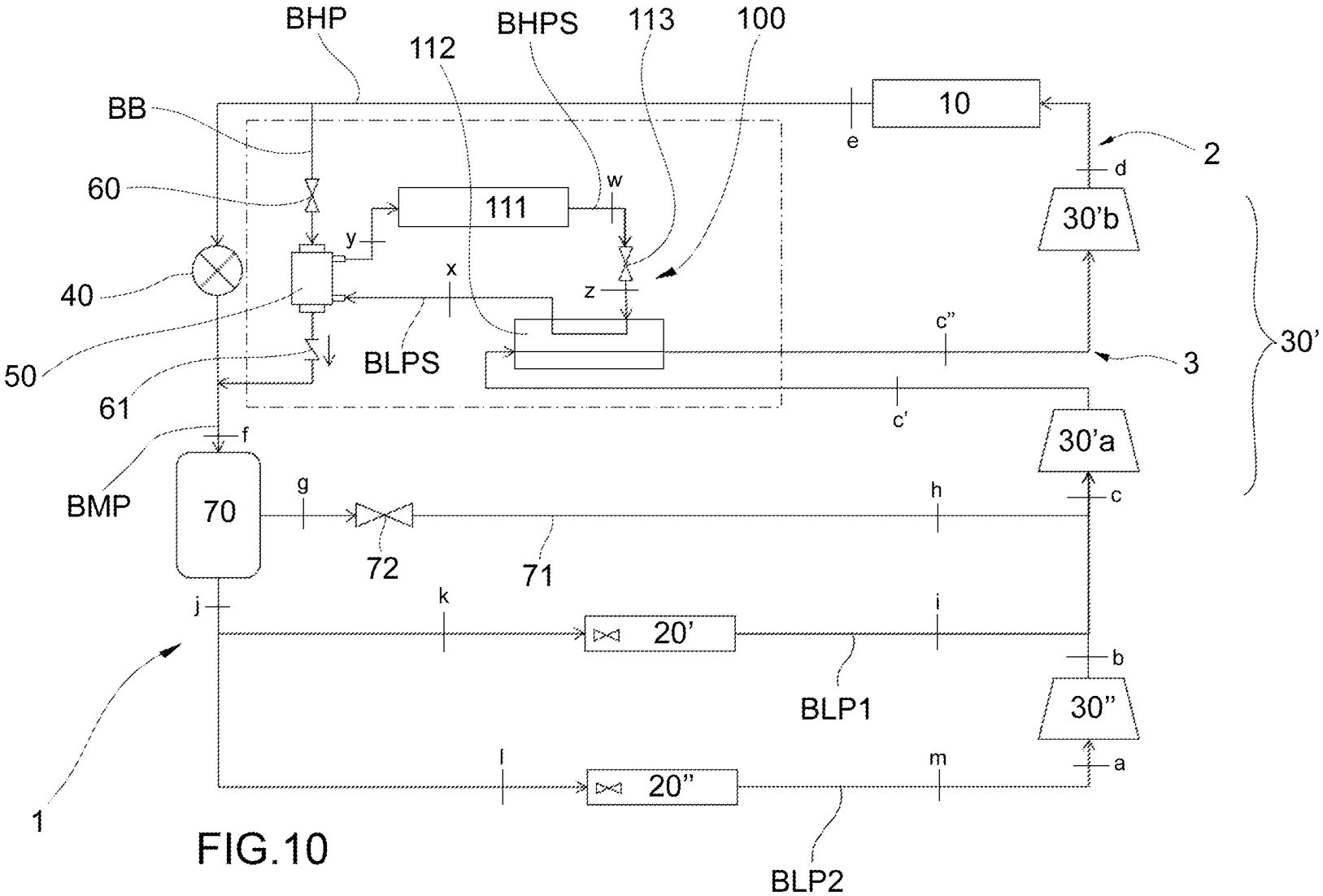
FIG. 10 shows a simplified diagram of a vapour compression refrigeration system in accordance with a fourth embodiment of the present invention.
Figure 11:
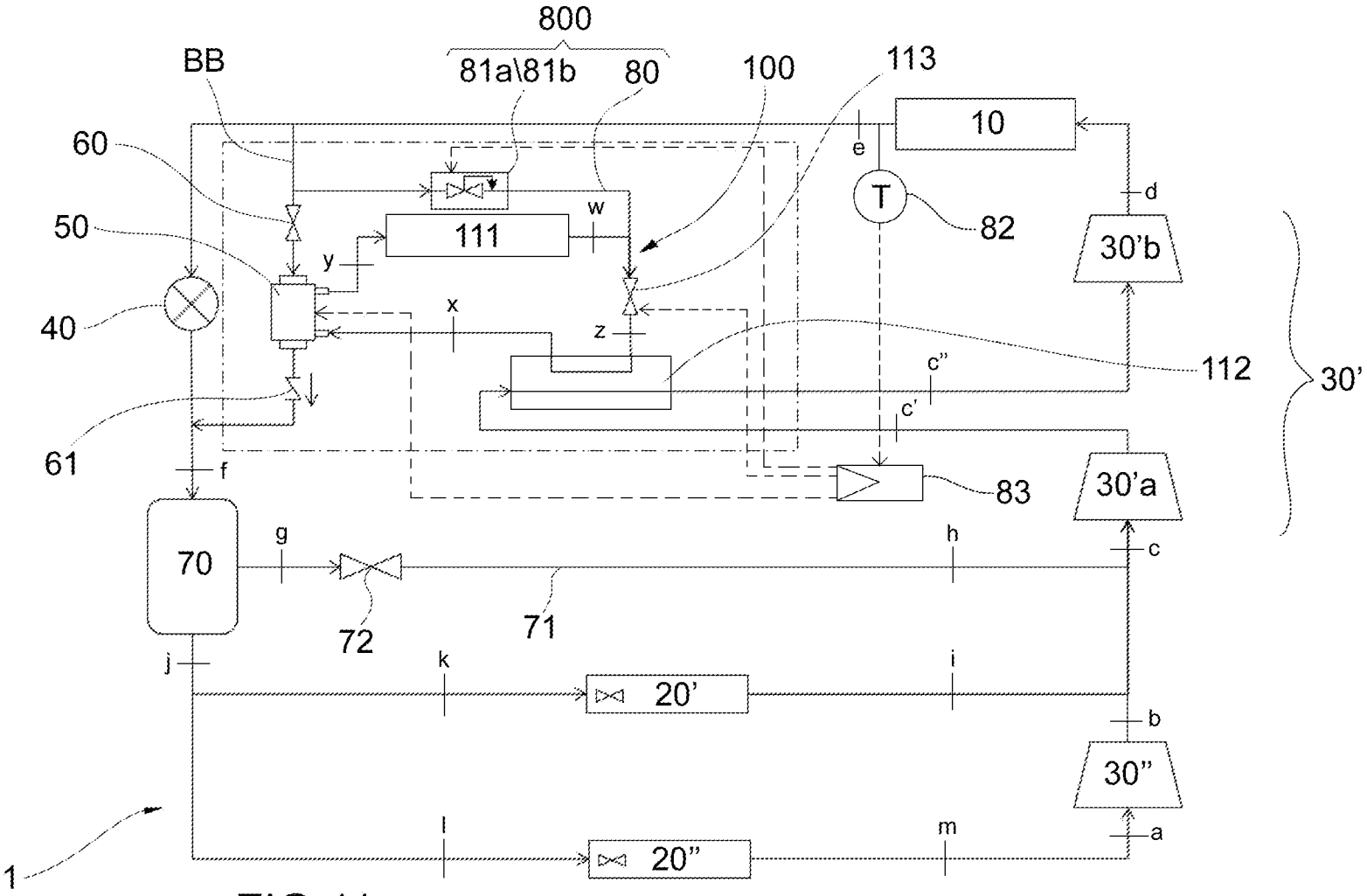
FIG. 11 shows a simplified diagram of the refrigeration system in FIG. 10, provided with a refrigerant charge management system.
Figure 14:
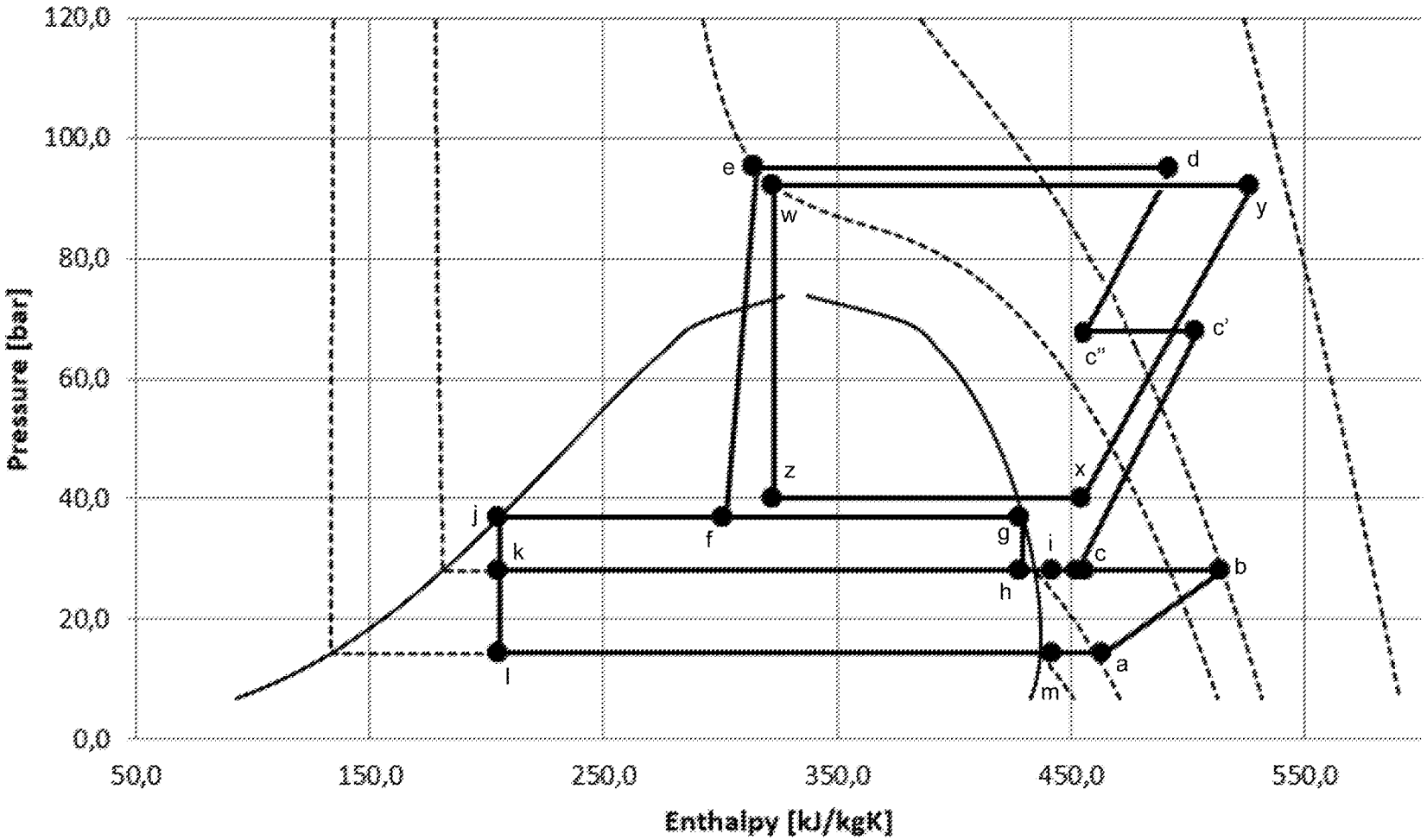
FIG. 14 shows, in a pressure—enthalpy diagram, the operation of the plant modes in FIGS. 10 and 11.

In accordance with a fourth embodiment, illustrated in FIGS. 10 and 11, the main compressor 30' of the main refrigerant circuit 2 is two-stage compression 30'*a* and 30'*b*. In such a case, the secondary evaporator 112 of the secondary refrigerant circuit 100 can be thermally connected to a section of the main refrigerant circuit 2 between the two compression stages and acts as an inter-refrigeration stage. The diagram p-h of the thermodynamic cycle is shown in FIG. 14.

Operatively, the cooling effect of the secondary refrigerant circuit is used to reduce the temperature (de-superheat) of the refrigerant between the two compression stages 30'*a* and 30'*b*. The consumption of the second compression stage 30'*b* and therefore of the entire refrigeration system 1 is thus reduced.

Such a solution offers the following advantages:

- the discharge temperatures of the second compression stage 30'*b* are considerably reduced, resulting in benefits in terms of machine wear and oil consumption;
- strong reduction in energy consumption for medium temperature compressors.

Preferably, as shown in FIGS. 5, 7, 9 and 11 the refrigeration system 1 can comprise:

- a temperature sensor 82 placed at the outlet of the main gas cooler or condenser 10; and
- a controller 83 which is connected to said temperature sensor 82, said secondary expansion device 113, said by-pass valve 60 and the rotary pressure exchanger 50 (through the control inverter of the motor thereof).

Preferably, the aforesaid controller 83 is programmed to maintain a predetermined degree of superheating of the gas at the outlet of the secondary low pressure branch BLPs of the evaporator 112, so as to generate the refrigeration capacity required by the secondary evaporator 112, while ensuring the necessary pressure upstream of the secondary expansion device 113 with any additions of refrigerant in the secondary refrigerant circuit 100 through the refrigerant supply branch 80.

Operatively, the controller 83 receives a signal from the temperature sensor 82 placed at the outlet of the main gas cooler or condenser 10 and, in the absence of system alarms and with at least one medium temperature compressor in operation, activates or deactivates the secondary circuit 100 based on a preset temperature threshold. In case of activation, the controller 83:

- opens the by-pass valve 60 (on-off valve);
- opens the secondary expansion device 113, which begins the regulation logic thereof, i.e., for example, it maintains a preset degree of superheating of the gas at the outlet of the low-pressure secondary branch BLPs of the evaporator 112, so as to generate the refrigeration capacity required by the secondary evaporator 112 (which can act as a sub-cooler (see FIG. 4), be subordinated to an external refrigerating utility EF (see FIG. 8), or be subordinated to an inter-refrigeration stage (see FIG. 10);
- activates the rotary pressure exchanger 50, regulating the speed thereof to maintain an adequate level of pressure to the main gas cooler or condenser 10 in cooperation with the main expansion device 40;
- activates the charge management system 800.

In case of deactivation, the controller 83 performs the previous steps in the opposite sequence.

As already highlighted, the charge management system 800 creates a further branch of fluid communication between the high pressure outlet of the secondary evaporator 112 and the inlet of the secondary expansion device 113: when the pressure at the inlet of the secondary expansion device 113 is not sufficiently high, the charge management system injects liquid into the secondary circuit so as to raise the pressure thereof.

The management method of a vapour compression refrigeration system according to the invention will now be described.

The management method of the refrigeration system 1 according to the invention comprises the following operating steps:

a) preparing a vapour compression refrigeration system 1 according to the invention; for the sake of simplicity of description, the entire description of the refrigeration system 1 will not be repeated, but reference will be made to the description previously provided b) flowing at least a part of the refrigerant flow of the main refrigerant circuit 2 through the rotary pressure exchanger 50 by opening the by-pass valve 60 and activating the rotary pressure exchanger 50, thereby recovering energy from the expansion of the high pressure refrigerant to compress the refrigerant of the secondary refrigerant circuit 100 from the secondary low pressure to the secondary high pressure and thus making cooling power available to the secondary evaporator 112 of the secondary refrigerant circuit 100; and c) using said cooling power available at the secondary evaporator 112 of the secondary refrigerant circuit 100.

Advantageously, during step c) a sub-cooling effect will be obtained in the main refrigerant circuit 2 ensuring the necessary pressure upstream of the secondary expansion device 113 with additions of refrigerant in the secondary refrigerant circuit 100 through the refrigerant supply branch 80.

In accordance with a preferred embodiment shown in FIGS. 4 to 7, step c) of using the cooling power available at the secondary evaporator 112 of the secondary refrigerant circuit 100 consists in sub-cooling the refrigerant exiting the main gas cooler or condenser 10 of the main refrigerant circuit 2.

In accordance with a preferred embodiment shown in FIGS. 8 and 9, step c) of using the cooling power available to the secondary evaporator 112 of the secondary refrigerant circuit 100 consists in transferring said cooling power to an external refrigerating utility.

In accordance with a preferred embodiment shown in FIGS. 10 and 11, step c) of using the cooling power available to the secondary evaporator 112 of the secondary refrigerant circuit 100 consists in cooling the refrigerant of the main refrigerant circuit 2 flowing between two consecutive compression stages, thereby defining an inter-refrigeration stage.

The invention allows to obtain several advantages which have been explained in the description.

The vapour compression refrigeration system with rotary pressure exchanger according to the invention is capable of recovering energy from the expansion process through the pressure exchanger without the aid of a low differential pressure device.

The refrigeration system with rotary pressure exchanger according to the present invention is constructively simple to manufacture, with plant costs comparable to those of traditional plants.

The refrigeration system with rotary pressure exchanger according to the present invention is reliable and operatively simple to manage.

Therefore, the invention thus devised achieves the pre-set objects.

Obviously, in the practice thereof, it may also take different shapes and configurations from that disclosed above, without departing from the present scope of protection.

Moreover, all details may be replaced by technically equivalent elements, and any size, shape, and material may be used according to needs.

What is claimed is:

1. A vapour compression refrigeration system, capable of operating in a transcritical mode and in a subcritical mode, the vapour compression refrigeration system comprising a main refrigerant circuit that in turn comprises:

a high pressure branch for circulating a refrigerant therethrough at a high pressure;

a main gas cooler or condenser arranged in the high pressure branch;

at least a first low pressure branch for circulating the refrigerant therethrough at a first low pressure;

at least a first main evaporator arranged in the first low pressure branch;

at least one main compressor that fluidically connects the first low pressure branch to the high pressure branch;

an intermediate pressure branch for circulating the refrigerant therethrough at an intermediate pressure between said high pressure and said first low pressure;

an expansion device connecting the high pressure branch to the intermediate pressure branch downstream of said main gas cooler or condenser;

wherein the vapour compression refrigeration system comprises a by-pass branch connecting the high pressure branch to the intermediate pressure branch downstream of said expansion device and provided with a by-pass valve, wherein the vapour compression refrigeration system comprises a secondary refrigerant circuit in turn comprising:

a secondary high pressure branch for circulating the refrigerant therethrough at a secondary high pressure lower than said high pressure;

a secondary gas cooler or condenser arranged in the secondary high pressure branch;

a secondary low pressure branch for circulating the refrigerant therethrough at a secondary low pressure;

at least one secondary evaporator arranged in the secondary low pressure branch;

a secondary expansion device connecting the secondary high pressure branch to the secondary low pressure branch downstream of said secondary gas cooler or condenser, and wherein the vapour compression refrigeration system further comprises a rotary pressure exchanger fluidically connected to the by-pass branch downstream of the by-pass valve and the secondary refrigerant circuit, wherein the rotary pressure exchanger comprises a high pressure inlet port, a low pressure inlet port, a high pressure outlet port, and a low pressure outlet port, and is configured for:

receiving the refrigerant entering the high pressure inlet port from the high pressure branch of the main refrigerant circuit through the by-pass branch, receiving the refrigerant entering the low pressure inlet port from the secondary low pressure branch of the secondary refrigerant circuit, exchanging pressure between the refrigerant at the high pressure and the refrigerant at the secondary low pressure, introducing the refrigerant exiting the high pressure outlet port into the secondary high pressure branch of the secondary refrigerant circuit; and introducing the refrigerant exiting the low pressure outlet port into the intermediate pressure branch of the main refrigerant circuit through the by-pass branch.

2. The vapour compression refrigeration system of claim 1, further comprising a liquid receiver that is arranged in the intermediate pressure branch downstream of a confluence point of the by-pass branch and fluidically connected: i) to the high pressure branch with a connection branch provided with a regulation valve, ii) through a dedicated compressor a discharge port of which is connected to the high pressure branch, or iii) through the main compressor.

3. The vapour compression refrigeration system of claim 1, comprising a non-return valve arranged in the by-pass branch downstream of the rotary pressure exchanger.

4. The vapour compression refrigeration system of claim 1, further comprising a refrigerant supply branch which:

fluidically connects the high pressure branch of the main refrigerant circuit to the secondary refrigerant circuit downstream of the secondary gas cooler or condenser and upstream of the secondary expansion device, and is provided with at least one regulation valve or at least one differential non-return valve.

5. The vapour compression refrigeration system of claim 4, wherein the refrigerant supply branch is provided with a regulation valve and a differential non-return valve connected to each other in series or in parallel.

6. The vapour compression refrigeration system of claim 1, wherein the secondary evaporator of the secondary refrigerant circuit is thermally connected with the high pressure branch of the main refrigerant circuit downstream of the main gas cooler or condenser and acts as a sub-cooler for the main refrigerant circuit.

7. The vapour compression refrigeration system of claim 1, wherein the secondary gas cooler or condenser of the secondary refrigerant circuit is integrated in the main gas cooler or condenser.

8. The vapour compression refrigeration system of claim 1, wherein the secondary evaporator of the secondary refrigerant circuit (100) is thermally connected to an external refrigerating utility.

9. The vapour compression refrigeration system of claim 1, wherein the main compressor of the main refrigerant circuit comprises two-stage compression and wherein the secondary evaporator of the secondary refrigerant circuit is thermally connected to a section of the main refrigerant circuit between the two compression stages and acts as an inter-refrigeration stage.

10. The vapour compression refrigeration system of claim 1, further comprising:

a temperature sensor placed at an outlet of the main gas cooler or condenser; and a controller connected to said temperature sensor, said secondary expansion device, said by-pass valve and the rotary pressure exchanger, wherein said controller is programmed to maintain a predetermined degree of superheating of gas at an outlet of the secondary low pressure branch of the secondary evaporator, so as to generate a refrigeration capacity required for operation of the secondary evaporator, while ensuring a pressure upstream of the secondary expansion device is sufficient for operation of the secondary expansion device with any additions of refrigerant in the secondary refrigerant circuit through the refrigerant supply branch.

11. The vapour compression refrigeration system of claim 1, further comprising a second low pressure branch for circulating the refrigerant therethrough at a second low pressure, said second low pressure branch comprising a second main evaporator and being fluidically connected upstream to the intermediate pressure branch and downstream, directly or indirectly, to the high pressure branch through an additional compressor arranged in series or in parallel with said main compressor.

12. A method for managing a vapour compression refrigeration system, comprising the following operating steps:

a) providing the vapour compression refrigeration system, capable of operating in a transcritical mode and in a subcritical mode, the vapour compression refrigeration system comprising a main refrigerant circuit that in turn comprises:

a high pressure branch for circulating a refrigerant therethrough at a high pressure;

a main gas cooler or condenser arranged in the high pressure branch;

at least a first low pressure branch for circulating the refrigerant therethrough at a first low pressure;

at least a first main evaporator arranged in the first low pressure branch;

at least one main compressor that fluidically connects the first low pressure branch to the high pressure branch;

an intermediate pressure branch for circulating the refrigerant therethrough at an intermediate pressure between said high pressure and said first low pressure;

an expansion device connecting the high pressure branch to the intermediate pressure branch downstream of said main gas cooler or condenser;

wherein the vapour compression refrigeration system comprises a by-pass branch connecting the high pressure branch to the intermediate pressure branch downstream of said expansion device and provided with a by-pass valve, wherein the vapour compression refrigeration system comprises a secondary refrigerant circuit in turn comprising:

a secondary high pressure branch for circulating the refrigerant therethrough at a secondary high pressure lower than said high pressure;

a secondary gas cooler or condenser arranged in the secondary high pressure branch;

a secondary low pressure branch for circulating the refrigerant therethrough at a secondary low pressure;

at least one secondary evaporator arranged in the secondary low pressure branch;

a secondary expansion device connecting the secondary high pressure branch to the secondary low pressure branch downstream of said secondary gas cooler or condenser and wherein the vapour compression refrigeration system further comprises a rotary pressure exchanger fluidically connected to the by-pass branch downstream of the by-pass valve and the secondary refrigerant circuit, wherein the rotary pressure exchanger comprises a high pressure inlet port, a low pressure inlet port, a high pressure outlet port, and a low pressure outlet port, and is configured for:

receiving the refrigerant entering the high pressure inlet port from the high pressure branch of the main refrigerant circuit through the by-pass branch, receiving the refrigerant entering the low pressure inlet port from the secondary low pressure branch of the secondary refrigerant circuit, exchanging pressure between the refrigerant at the high pressure and the refrigerant at the secondary low pressure, introducing the refrigerant exiting the high pressure outlet port into the secondary high pressure branch of the secondary refrigerant circuit; and introducing the refrigerant exiting the low pressure outlet port into the intermediate pressure branch of the main refrigerant circuit through the by-pass branch;

b) flowing at least a part of the refrigerant of the main refrigerant circuit through the rotary pressure exchanger by opening the by-pass valve and activating the rotary pressure exchanger, thereby recovering energy from expansion of the refrigerant at the high pressure to compress the refrigerant of the secondary refrigerant circuit from the secondary low pressure to the secondary high pressure and thus making cooling power available to the secondary evaporator of the secondary refrigerant circuit; and c) using the cooling power available at the secondary evaporator of the secondary refrigerant circuit.

13. The method of claim 12, wherein during step c) a predetermined degree of superheating of gas at an outlet of the secondary low pressure branch of the secondary evaporator is maintained, so as to generate a refrigeration capacity required for operation of the secondary evaporator, while ensuring a pressure upstream of the secondary expansion device is sufficient for operation of the secondary expansion device with any additions of refrigerant in the secondary refrigerant circuit through the refrigerant supply branch.

14. The method of claim 12, wherein step c) of using the cooling power available at the secondary evaporator of the secondary refrigerant circuit consists in sub-cooling the refrigerant exiting the main gas cooler or condenser of the main refrigerant circuit.

15. The method of claim 12, wherein step c) of using the cooling power available at the secondary evaporator of the secondary refrigerant circuit consists in transferring said cooling power to an external refrigerating utility.

16. The method of claim 12, wherein step c) of using the cooling power available at the secondary evaporator of the secondary refrigerant circuit consists of cooling the refrigerant of the main refrigerant circuit flowing between two consecutive compression stages thereby defining an inter-refrigeration stage.

* * * * *